US005499422A

United States Patent [19]

Lavazoli

[11] Patent Number: 5,499,422

[45] Date of Patent: Mar. 19, 1996

[54] ROTATING HEAD TOOTH BRUSH

[76] Inventor: Rudi Lavazoli, 10 Beech Ct., College Point, N.Y. 11356

[21] Appl. No.: 368,854

[22] Filed: Jan. 5, 1995

[51] Int. Cl.[6] ..... A46B 9/04

[52] U.S. Cl. ..... 15/167.1; 15/144.1; 15/172; 403/84

[58] Field of Search ..... 15/144.1, 167.1, 15/172; 403/83, 84, 87, 91

[56] References Cited

U.S. PATENT DOCUMENTS

| | | | |
|---|---|---|---|
| 1,188,614 | 6/1916 | Bowen . | |
| 1,442,363 | 1/1923 | Saxe | 15/172 |
| 1,675,139 | 6/1928 | Saxe | 15/172 |
| 1,752,393 | 4/1930 | Rawson . | |
| 2,047,613 | 7/1936 | Brown . | |
| 2,618,801 | 11/1952 | Hibbs | 15/167.1 |
| 5,165,135 | 11/1992 | Su | 15/172 |

FOREIGN PATENT DOCUMENTS

| | | | |
|---|---|---|---|
| 50937 | 2/1910 | Switzerland | 15/172 |
| 22340 | 10/1905 | United Kingdom . | |
| 5706 | 3/1910 | United Kingdom | 15/172 |
| 202540 | 8/1923 | United Kingdom | 15/144.1 |
| 21776 | 9/1987 | United Kingdom | 15/144.1 |

*Primary Examiner*—Mark Spisich
*Attorney, Agent, or Firm*—Richard L. Miller

[57] ABSTRACT

A manually rotatable head toothbrush with a minimum number of parts and utilizing properties of an elastomeric material in the construction thereof, so as to thus providing suitable resistance to rotation such that any desired orientation of brush head to handle can be maintained when the toothbrush is in use.

2 Claims, 1 Drawing Sheet

ROTATING HEAD TOOTH BRUSH

CROSS REFERENCES

This application discloses subject matter similar to that previously disclosed by U.S. application Ser. No. 07/856,365, filed Mar. 23, 1992 and abandoned for lack of prosecution, by the same applicant.

BACKGROUND OF THE INVENTION

This invention relates to new and useful improvements in tooth brushes, and the primary object of the present invention is to provide a rotating head tooth brush with fewer parts than previous rotating head tooth brushes with resultant ease of cleaning and ease of manufacture.

DESCRIPTION OF RELATED ART

A rotating head tooth brush is described in U.S. Pat. No. 22,340 to Grau. The invention disclosed therein provides a tooth brush, the brush head of which is rotatively mounted on the handle by means of a rivet passing through the tooth brush head and the handle. The tooth brush head and handle are maintained at a spaced relationship to each other by a washer placed between them and through which the rivet passes. A spring mounted in the handle just below the head of the rivet exerts pressure on the washer thus holding the tooth brush head and handle at any desired orientation to each other.

A rotating head tooth brush with an improved pivot is described in U.S. Pat. No. 1,188,614 to Bowen. The invention disclosed therein provides a tooth brush, the tooth brush head of which is rotatively mounted on the handle by means of a rivet-like arrangement in which additional frictional engagement is provided flanges and disks recessed in both the brush head and the handle.

A rotating head tooth brush with a clamp-carrying handle is described in U.S. Pat. No. 1,752,393 to Rawson. The invention disclosed therein provides a tooth brush, the tooth brush head of which is rotatively mounted on the handle by means of a pin passing through the brush head and a looped terminal attached to the handle. Friction to hold the brush head in the desired orientation with respect to the looped terminal by a convex spring disk.

A rotating head tooth brush with recessed corrugated disks is described in U.S. Pat. No. 2,047,613 to Brown. The invention disclosed therein provides a tooth brush, the tooth brush head of which is rotatively mounted on the handle by means of a stud. Countersunk into both the brush head and the handle end adjacent to the brush head are corrugated spring disks whereby the brush head is held in the desired orientation to the brush handle.

A root and gum stimulator with a rotating brush head is described in U.S. Pat. No. 2,618,801 to Hibbs. The invention disclosed therein provides a tooth brush, the tooth brush head of which is rotatively mounted on the handle by means of a rivet which passes through the handle and through the channel shaped retaining member which holds the brush head. Conical recesses in the end of the handle to which the brush head is rotatively attached contact protuberances along the upper face of the channel retaining member as it is rotated thus holding the brush head in the desired orientation with respect to the handle. One would rotate the brush head until it clicks into the desired orientation with respect to the handle.

Each of these inventions utilizes fairly complicated mechanism to hold the brush head in the desired orientation with respect to the brush handle. The Grau patent utilizes a spring which will tend to become clogged with tooth paste in time thus providing an ideal breeding ground for bacteria. The Bowen patent has a tubular post which will quickly become clogged with tooth paste. The Rawson patent utilizes a complicated spring arrangement to provide the proper friction. The corrugated disks of the Brown patent will eventually become clogged with toothpaste and become a breeding ground for bacteria. The arrangement of the conical recesses and protuberances of the Hibbs patent provide only a limited number of orientations of the brush head with respect to the handle.

SUMMARY OF INVENTION, OBJECTS AND ADVANTAGES

Accordingly, the above problems and difficulties are obviated by the present invention which provides for a simple friction disk between the brush head and the handle. Due to only having two moving parts, the instant invention will be easy to clean and manufacture. The friction disk is made typically of an elastomeric polymer and is in a somewhat compressed state in the instant invention. The optimum amount of friction between the brush head and the handle is provided by having the friction disk under sufficient pressure in the instant invention that the desired orientation of the brush to the handle is maintained under ordinary use but not under such pressure that the brush head would be overly difficult to rotate with respect to the handle, when the user so desires. A less preferred embodiment provides that it is the handle rather than the friction disk which is in a compressed state, the handle thus exerting pressure on the friction disk and thus on the brush head. Having pressure exerted on it, the friction disk provides sufficient resistance to rotation of the brush head with respect to the handle that these two can be maintained in any desired orientation with respect to each other. Another less preferred embodiment provides that it is the brush head rather than the friction disk which is in a compressed state, with the same effect as in the other less preferred embodiment.

It is therefore an object of the present invention to provide a tooth brush with a rotating head wherein only two parts interface between the brush and handle: a friction disk and a rivet. It is a further object of this invention to provide a simple easily manufactured and easily cleaned rotating head toothbrush without springs to get clogged, without hidden voids where sanitary problems can arise. It is a further object of this invention to provide means to rotate the head 360 degrees with respect to the handle without snaps or detents. It is a further object of this invention to provide a toothbrush with a handle grip which makes it easy to hold in all positions.

The characteristics of this invention result in a rotating head toothbrush which is simpler, easier to clean, and more economical to manufacture than any of the prior art rotating head toothbrushes.

Further scope of applicability of the present invention will become apparent from the detailed description given hereafter. However, it should be understood that the drawings and the detailed description, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF PREFERRED EMBODIMENT

Figure 1:
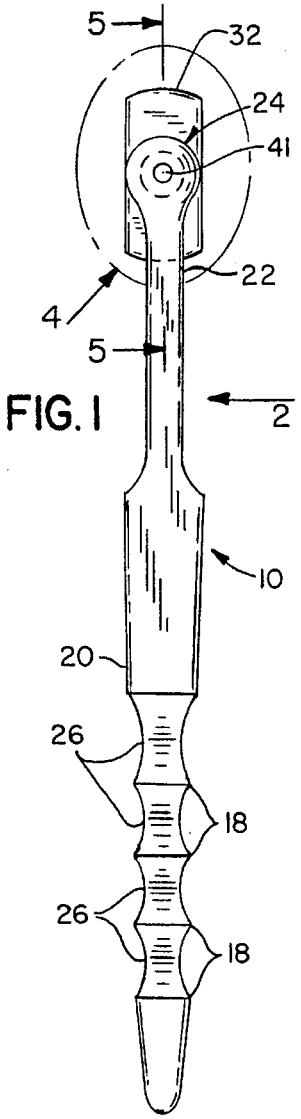
FIG. 1 is a diagrammatic plan elevational view of the instant invention.
Figure 2:
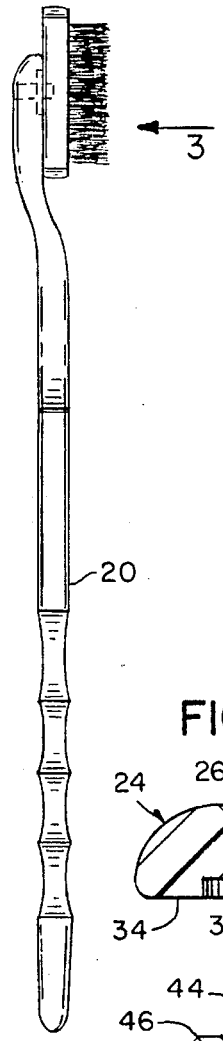
FIG. 2 is a side elevational view taken in the direction of arrow 2 in FIG. 1.
Figure 3:
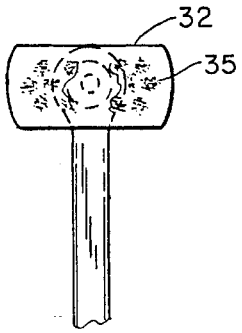
FIG. 3 is a diagrammatic elevational view with parts broken away taken in the direction of arrow 3 in FIG. 2 from the direction of the bristles, but with the head rotated 90 degrees from the position illustrated in FIG. 1.
Figure 4:
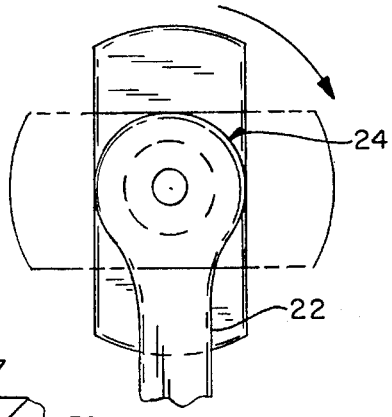
FIG. 4 is a diagrammatic enlarged view with parts broken away taken in the area of the dotted ellipse indicated by arrow 4 in FIG. 1 illustrating that the head can be rotated a full 360 degrees.
Figure 7:
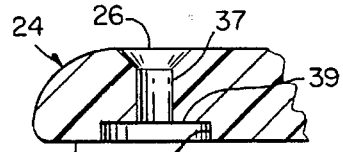
FIG. 7 is an enlarged diagrammatic cross section view of the terminal per se with parts broken away and with the rivet and friction disk removed so that the recess in which the rivet rests can be clearly distinguished.

The rotating head toothbrush is generally shown in FIG. 1 as 10. The toothbrush handle has two ends, a hand grip end 20 and a brush head end 22. The hand grip end 20 has spaced peaks 18 and valleys 26, so spaced as to provide a comfortable hand grip, thus making it easy to hold the tooth brush in any position. The brush head end of the handle terminates in a circularly shaped terminal 24 in the center of which is a circular hole shown as 26 in FIG. 7 for holding a rivet shown as 28 in FIG. 5. The terminal 24 has an upper surface 30 which is remote from the brush head 32 and a lower surface 34 which is proximate to the brush head 32. The lower surface 34 of the terminal 24 is provided with a wide circular opening shown as 36 in FIG. 7 which is formed with a circular step or shoulder to accommodate a circular friction disk 38. In the center of the step surface 39 of the wide circular opening 36 is a smaller circular hole 37 which is the extension of circular hole 26 and corresponds to the diameter of rivet 28. FIG. 3 shows the brush bristles 35 extending outward from the brush head 32.

Figure 5:
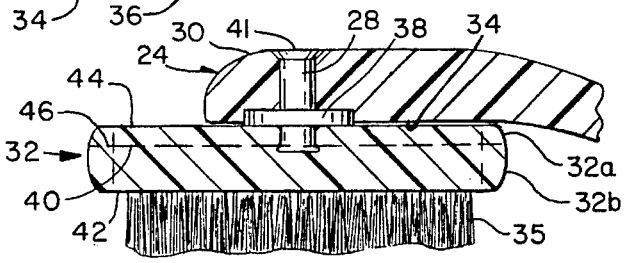
FIG. 5 is an enlarged diagramatic cross sectional view with parts broken away taken on line 5—5 of FIG. 1.
Figure 6:
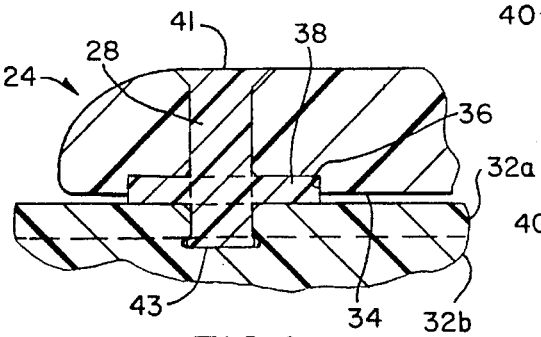
FIG. 6 is an enlarged diagrammatic cross sectional view illustrating the rotational pivot structure in greater detail.

The head of the tooth brush is generally shown as numeral 32 in FIG. 5. The brush head 32 is comprised of two sections, a nonbristled section **32*a* and a bristled section 32*b*, which are laminated together. The nonbristled section 32*a* of the brush head is that portion of the brush head closes to the handle. The bristled section 32*b* of the brush head is that portion of the brush head which holds the bristles 35. FIGS. 5 and 6 show that the finished or closed head 41 of the rivet 28 is countersunk into the upper surface 30 of the terminal 24. FIG. 6 shows that the open end 43 of the rivet 28 has been hammered and firmly holds the nonbristled section 32*a* of the brush head against the friction disk 38 which rests in the step 36 of the terminal 24. The bristled section 32*b* of the brush head has an inner surface 40 and an outer surface 42. The inner surface 40 of the bristled section 32*b* of the brush head is laminated or glued to the nonbristled section 32*a* of the brush head thus covering the compressed end 43 of the rivet 28. The outer surface 42 of the bristled section 32*b* bears the brush bristles 35**.

Figure 8:
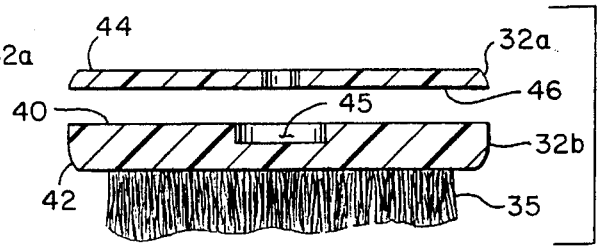
FIG. 8 is an exploded and enlarged diagrammatic cross section view of the brush head with the rivet removed to more clearly illustrate the interface between the bristled and nonbristled sections of the brush head.

FIG. 8 is an exploded and enlarged cross sectional view of the brush head with the rivet removed and clearly shows the interface between the nonbristled and bristled sections of the brush head and that there is a small indentation 45 in the bristled section to accommodate the head 43 formed on the open end of the rivet 28 when it is headed. The rivet 28 with flared head 43 is shown in FIG. 6.

The operation and use of the preferred embodiment of the instant invention can be described referring to FIG. 1. One would adjust the brush head 32 to the desired orientation with respect to the handle, and commence to brush one's teeth. When a different orientation is desired for a different cleaning effect, one could either hold the brush head 32 with one's teeth and rotate the handle to a new orientation, or remove the tooth brush from one's mouth and adjust the brush head by hand to the desired orientation.

Whether it is the friction disk, the nonbristled section of the brush head, or the handle which is wade of a compressible material, the method of manufacture is the same. Well known techniques would be utilized to manufacture the brush handle, and the bristled and nonbristled sections of the brush head 32. A suitably sized hole 26 is formed through the center of the terminal 24 of the brush handle and the nonbristled section **32*a* of the brush head. The outer surface 30 of the terminal 24 would have the hole widened at the surface to accommodate the closed end of a rivet 28 to be countersunk therein. The inner surface 34 of the terminal 24 in the vicinity of the hole 26 would have a circular step 36 cut into its surface to accommodate a friction disk 38 to be placed therein. The friction disk 38 would then be placed into the circular step 36 in the terminal 24, the inner surface 34 of the terminal would be placed flush with the upper surface 44 of the nonbristled section 32*a* of the brush head so that the holes in each lined up. The open end 43 of the rivet 28 would successively be passed through the outer surface 30 of the terminal 24, the friction disk 38, and the upper surface 44 of the nonbristled section of the brush head 32. The open end 43 of the rivet 28 would then be headed, thus causing the open end 43 protruding through the lower surface 46 of the nonbristled section 32*a* of the brush head, to flare outward. The rivet 28 thus tightly binds together the terminal 24, the friction disk 38, and the nonbristled section 32*a* of the brush head. The inner surface 40 of the bristled section 32*b* of the brush head would then be laminated or ultrasonically fused to the lower surface 46 of the nonbristled section 32*a*** of the brush head.

Preferably the rivet would be made of an inert material such as plastic, stainless steel, tin, titanium, or a gold plated metal. If it is the handle or the brush head which is to be compressible, they will be made from a firm, rigid, compressible plastic which is not subject to cold flow under pressure.

From the foregoing, it will be seen that I have provided a tooth brush which utilizes material under pressure to provide the proper frictional characteristics to provide a rotating head tooth brush with a minimal number of parts, and which is easily cleaned and manufactured.

CONCLUSION, RAMIFICATIONS, AND SCOPE OF INVENTION

Thus the reader will see that my invention supplies a long felt need for a toothbrush which can have the brush head maintained at any desired orientation with respect to the handle, with a minimum number of parts, and which is easily cleaned and manufactured. There are many variations of this tooth brush which can be made without departing from the inventive concepts expressed herein. For example, the rivet could be replaced by a threaded pin and nut. Or, the friction disk could be replaced by two friction disks, one embedded in the brush head and the other embedded in the handle in order to vary the amount of friction. Accordingly, the scope of my invention should be determined not by the embodiments described, but by the appended claims and their legal equivalents.

CLAIMS

What is claimed is:

1. A tooth brush comprising a brush head, a rivet, a friction disk, and an elongated handle having a first end comprising a terminal with an upper surface and a lower surface, and a second end, wherein:

a) the terminal has a hole in its upper surface for receiving the rivet and a widened recess in its lower surface for receiving the friction disk, the center of the upper hole registering with the center of the widened recess in the lower surface of the terminal;

b) the terminal is made of a compressible material without cold flow;

c) the friction disk is partially recessed in the widened recess in the lower surface of the terminal;

d) the brush head has a hole registering with the hole in the upper surface of the terminal and the widened recess in the lower surface of the terminal; and e) the rivet extends through the hole in the upper surface of the terminal, the friction disk, and into the hole in the brush head, said rivet having been hammered so as to compress the terminal and hold the terminal, the friction disk, and the brush head in close proximity, whereby the terminal being in a compressed state exerts pressure on the friction disk thus causing it to frictionally engage both the terminal and the brush head, whereby the brush head is rotatable with respect to the handle and is maintained in a desired orientation with respect to the brush handle by the frictional resistance supplied by the friction disk.

2. The tooth brush of claim 1 wherein the terminal of the elongated handle comprises an elastomeric polymer.

* * * * *